US005899824A

United States Patent [19]

Kurtz et al.

[11] Patent Number: 5,899,824

[45] Date of Patent: May 4, 1999

[54] SNAP-FIT DART AND ADAPTER

[75] Inventors: David L. Kurtz, Tenafly, N.J.; Frank Bilotta; Harry Kicks, both of Suffolk, United Kingdom

[73] Assignee: Accudart Corporation, East Rutherford, N.J.

[21] Appl. No.: 09/022,909

[22] Filed: Feb. 12, 1998

Related U.S. Application Data

[XX .

[60] Provisional application No. 60/039,714, Feb. 12, 1997.

[51] Int. Cl.[6] ..... F42B 6/04; F16B 21/07

[52] U.S. Cl. ..... 473/578; 473/584; 403/326; 403/329

[58] Field of Search ..... 403/299, 326, 403/327, 328, 329; 473/578, 582, 584, FOR 216, FOR 219, FOR 222

[56] References Cited

U.S. PATENT DOCUMENTS 4,885,800 12/1989 Ragle ..... 473/578 X 5,366,314 11/1994 Young ..... 403/299

5,417,439 5/1995 Bickel ..... 473/578

5,636,846 6/1997 Tinsley ..... 473/584

*Primary Examiner*—John A. Ricci

*Attorney, Agent, or Firm*—Arthur L. Plevy, Esq.; Greenbaum, Rowe, Smith, Ravin, Davis & Himmel LLP

[57] ABSTRACT

The present invention involves a dart having a dart shaft that can be snap-fit into a corresponding dart barrel. The dart shaft has a cylindrical projection that terminates in a flange having indentations or detents on its peripheral surface. The dart barrel has a recess; flexible elongated arms extending into the recess of the dart barrel, removed from the walls of the dart barrel for clasping the dart shaft. The arms have indents or detents corresponding to the indents or detents of the projection, and the arms flex on and off the cylindrical projection of the dart shaft as the indents and detents are aligned and adjusted. The invention further relates to an adapter that can be used to modify a conventional threaded dart into the snap-fit dart of the present invention.

20 Claims, 5 Drawing Sheets

SNAP-FIT DART AND ADAPTER

CLAIM FOR PRIORITY UNDER 35 U.S.C. 119 (e)

Applicant hereby claims priority under 35 U.S.C. 119(e) for the present application based on a provisional application, U.S. Ser. No. 60/039,714, filed Feb. 12, 1997, entitled SNAP-FIT DART AND ADAPTER.

FIELD OF THE INVENTION

This invention pertains to a dart; in particular, it pertains to a dart having a shaft that can be snap-fit into a corresponding dart barrel. Further, the invention relates to an adapter that can be used to modify a conventional threaded dart assembly into the snap-fit dart of the present invention.

BACKGROUND OF THE INVENTION

This invention relates to a dart of the type having a snap-fit, detachable dart shaft and flight assembly.

In the past, darts used in the game of dart-throwing have been made with separable, interconnecting parts. Typically, a dart will comprise a pin or tip, a dart barrel, a dart shaft, and a flight assembly which holds the flights or feathers.

At one end of the dart is the pin or tip. The tip is usually secured to a shaft which, in turn, is secured to the dart barrel; alternatively, the tip may be integrally attached to the dart barrel. The flight assembly is attached to the other end of the dart barrel for balancing the dart and furthering its aerodynamic qualities. The portion of the dart extending from the barrel to the end of the flight assembly may also comprise a separable dart shaft.

Traditionally, the component parts of the dart have been connected together by coactively threaded sections. In particular, the dart barrel typically will have a threaded recess, and the dart shaft for holding the flight assembly or tip will contain a threaded projection which screws into the recess of the dart barrel. The interchangeability of the dart parts allows users to expand on their dart collections and increase their variety of darts without having to buy complete new sets of darts; instead, they can buy the interchangeable dart parts.

However, the act of screwing out one dart part and exchanging it for another can be relatively time-consuming and interfere with the pleasure of the dart-throwing game. For example, users may want to quickly change the flights or flight assemblies used on the darts during the course of a game or in between games. Thus, it is desirable to have dart parts, and particularly dart flight assemblies, that can be easily and quickly snapped together and apart.

Prior art patents show flights that can be detached without the use of threaded sections. For example, in U.S. Pat. No. 4,114,884, entitled DARTS, issued to Tunnicliffe on Sep. 19, 1978, there is shown a dart flight which slide-fits into slits on the end of the dart shaft. Similarly, in U.S. Pat. No. 3,990,705, entitled DART FLIGHTS, issued to Clarke on Nov. 9, 1976, there is shown a flight assembly which is slidably secured to a dart shaft with the use of pins. However, in both those patents, it is the flights themselves that are detachable; the dart shafts to which the flights are attached are screwed into the dart barrel. Additionally, with the inventions shown in these patents, a unique dart shaft designed to accommodate removable flights is required.

Detachable dart shafts, as opposed to dart flights, that can be attached or removed without the use of threaded sections are further shown in U.S. Pat. No. 5,324,004, entitled DART ASSEMBLY, issued to Giegerich on Jun. 28, 1994; U.S. Pat. No. 3,995,861, entitled DART FLIGHTS, issued to Clarke on Dec. 7, 1976; and U.S. Pat. No. 3,976,298, entitled DART, issued to Hinchman on Aug. 24, 1976.

More particularly, Giegerich shows a dart assembly that requires the use of a pin to hold the dart flight. The pin is inserted through a hole in both the flight assembly and the dart shaft; prongs extending from the dart shaft are compressed around the pin for insertion into the dart barrel. Since Giegerich requires use of a pin—an additional part—the dart invention of Giegerich is more complicated than the traditional dart. Also, the pin could be dropped, misplaced, or broken, or it could make use of the dart more cumbersome when a user attempts to engage or disengage the parts.

The dart shown in the Clarke '861 patent is more simple as compared with the Giegerich dart. The Clarke dart involves a spigot projecting from the dart barrel and a corresponding socket or recess within the dart shaft holding the flight assembly. The recess has detents for snap-fitting into indentations in the spigot. However, the surface of the spigot of Clarke slides directly over the surface of the recess in the dart barrel; thus, there is little, if any, flexibility in the snap-fit attachment and instead friction could result. Not only would this affect the ease of engaging the parts, but the dart parts and particularly the detents within the socket may become worn as the flight assembly is engaged and disengaged a number of times. The wearing of the detents eventually would adversely affect the integrity of the attachment, resulting in an insecure, wobbly dart, impairing its aerodynamic features.

Lastly, Hinchman shows a dart with detachable parts that disengage on impact such that the flight assembly will fall off the dart when the dart hits the dart board. With the dart of that invention, a user would be required to bend down and pick up the flight assembly from the floor or ground each time a dart is thrown and then re-engage the flight to the dart shaft.

Notably, each of the darts disclosed in the patents discussed above—Giegerich, Clarke, and Hinchman—require the use of specially-designed dart barrels that cannot be used with the traditionally threaded dart. Therefore, with those inventions, users could not expand on their dart collections by buying only dart parts but would be required to purchase a new line of dart barrels.

As the above background reveals, there is a need for a dart having a dart shaft and dart barrel that can be easily and securely snap-fit together which also is simple, involves few parts, and allows for flexibility in the attachment means so friction and wear and tear are minimized. There also is a need for a means of adapting the conventional threaded dart into the snap-fit type so that a user can use snap-fit parts without having to buy complete darts specifically designed for that purpose.

SUMMARY OF THE INVENTION

Summarily described, the invention embraces a dart having a dart shaft that snap-fits into a dart barrel. The dart shaft has a cylindrical projection that extends outwardly from the shaft and which has indents or detents near its peripheral edge. The dart barrel has a recess; a clasping means with elongated arms extends into the recess of the dart barrel, removed from the walls of the dart barrel. The clasping means has indents or detents corresponding to the indents or detents of the projection. When the projection is inserted into the recess of the dart barrel, the arms of the clasping means flex outwardly toward the walls of the dart barrel until the detents and indents are aligned, at which point the arms snap inwardly onto the projection. The clasping means can be integrally molded into the dart barrel, or preferably, it can be embodied in an adapter which screw-fits into a conventional dart barrel.

BRIEF DESCRIPTION OF THE DRAWINGS

For a better understanding of the present invention, an exemplary embodiment of the invention is described below, considered together with the accompanying drawings, in which:

FIGS. 2A through 2E show the present invention dart in operation, wherein FIGS. 2A through 2C show the dart shaft of the flight assembly being snap-fit onto the dart barrel, and FIGS. 2D and 2E show the dart shaft being removed from the dart barrel.

FIGS. 3A through 3F show the clasping means of the present invention in the form of an adapter, wherein:

FIG. 3A shows a top view of adapter;

FIGS. 3B and 3C show alternative exploded bottom views of the adapter; and FIGS. 3D through 3F show side views of different alternative embodiments of the adapter.

DETAILED DESCRIPTION OF THE DRAWINGS

Figure 1:
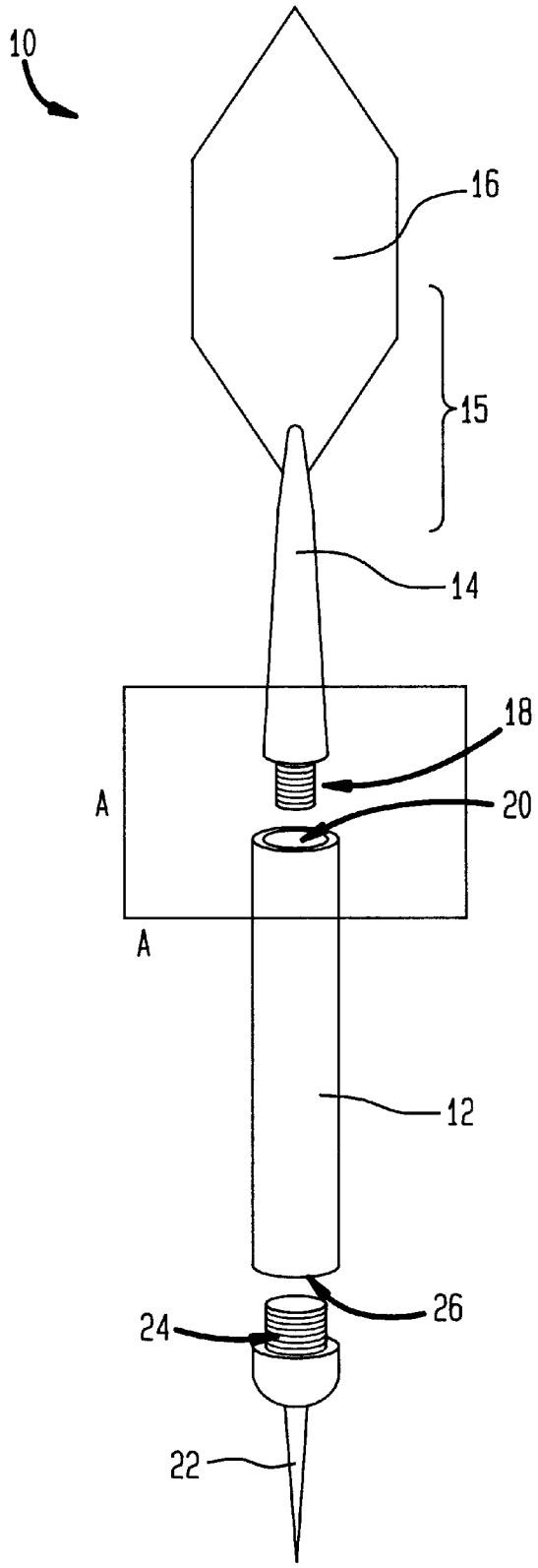
FIG. 1 (PRIOR ART)
FIG. 1 shows a prior-art dart having a threaded dart barrel and dart shaft.

Referring to FIG. 1, there is shown a conventional prior-art dart 10. The dart has a dart barrel or body 12, and a dart shaft 14 which holds the flights 16. The dart shaft 14 and flights 16 can also be referred to collectively as the flight assembly 15. The flight assembly 15 is secured to the dart barrel 12 with coactively threaded sections; the end of the shaft 14 contains a threaded projection 18 which is screwed into a threaded recess 20 within the barrel 12. Similarly, the dart tip 22 disposed at the opposite end of the dart is secured to the dart barrel by use of a threaded projection 24, which extends from the tip and screws into a corresponding threaded recess 26 within the dart barrel 12.

Figure 2:
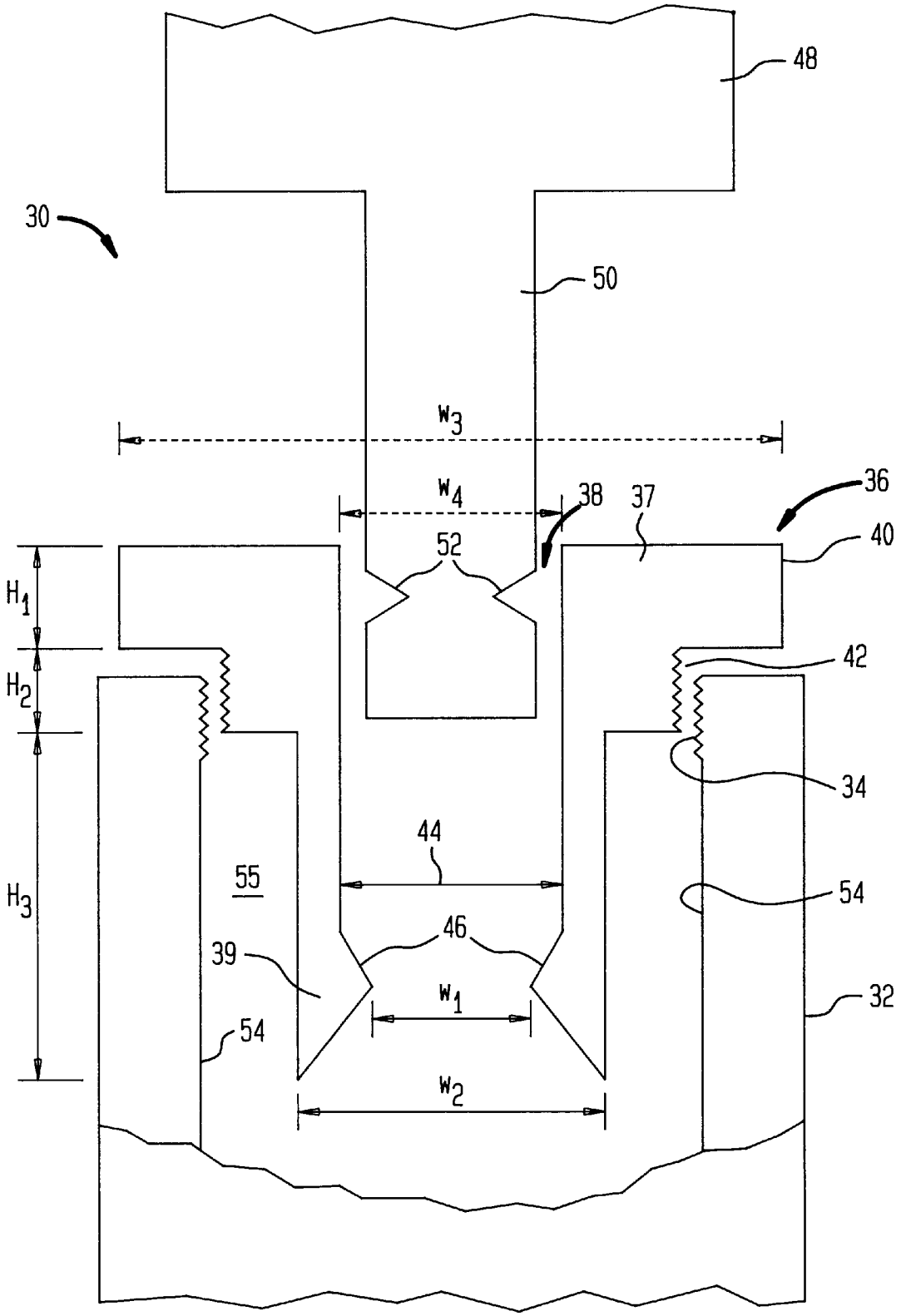
FIG. 2 shows an exploded cross-sectional view of a preferred embodiment of the present invention dart at the point of attachment between the dart barrel and dart shaft of the flight assembly (reflecting the boxed section A—A of FIG. 1).

The present invention relates primarily to the means of attaching the dart barrel 12 to the flight assembly 15, shown within the boxed area A—A of FIG. 1. Therefore, FIG. 2 shows an exploded view of that section of the dart. The same means of attachment may be used, however, to secure the tip 22 to the dart barrel 12, in place of the threaded projection 24 and recess 26 of FIG. 1.

Referring now to FIG. 2, there is shown an exploded cross-sectional view of the dart 30 of the present invention. The flight assembly 48 of the dart has an elongated projection 50 with a flange 52 at its terminus adapted to be inserted into the dart barrel 32, according to the invention. Here, the dart barrel 32 is shown as a conventional dart barrel, having a threaded recess 34, like the threaded recess 20 shown in FIG. 1. However, the dart barrel could be modified to a non-conventional dart barrel integrally incorporating the adapter 36, as will be later explained.

In a preferred embodiment of the present invention, the dart has an adapter 36. The adapter has an upper flange or base portion 37 having an inner bore 38, and a lower clasping portion 39. The base 37 of the adapter is substantially ring-like, as can be seen in a three-dimensional view, as in FIGS. 3D through 3F.

Looking at FIG. 2, the base 37 has an upper peripheral flange 40 of a given diameter and a lower peripheral flange 42 with a diameter smaller than the diameter of the upper flange 40. The periphery of the lower flange 42 has threads for screwing the adapter into the barrel 32 of a conventional dart. In a preferred embodiment, the periphery of the upper flange is knurled or forms a geometric shape, such as a hexagon, for making it easier for the user to grip the adapter and tighten it onto the dart barrel 32. The use of the threaded base and this construction of the adapter makes it possible to use the adapter to convert a conventional threaded dart into the snap-fit dart of the present invention.

The lower clasping portion of the adapter 39 contains a plurality of elongated arms 44. The arms have detents 46 on their inner surface, which extend inwardly relative to the dart barrel 32. The dart shaft of the flight assembly 48 has a projection 50 with indentations on its outer periphery, thus forming a flange 52, wherein the indentations correspond in dimension to the detents 46 on the arms 44 of the adapter. Although the invention is shown with indentations on the projection 50 and detents on the arms 44, the converse is also contemplated, i.e., detents on the projection 50 and corresponding indentations on the arms 44. However, the arms should be removed from the inner walls of the dart barrel 54 so that there is a free air space 55 in which the arms 44 can flex.

Preferably, the width W1 between the detents 46 in the arms 44 at their most inwardly disposed points (from apex to apex) is about 2.40 mm. The width W2 between the outer surfaces of the arms is preferably about 3.25 when the arms are in a resting position (as in FIGS. 2 and 2A), and the arms are pliable to flex outwardly so that W2 is about 3.50 mm when the arms are in an extended position (as in FIG. 2B). The width W3 of the diameter of the adapter at its upper surface is preferably about 6 mm. The width W4 of the bore in the adapter 38 at its uppermost opening is preferably about 2.60 mm. The height H1 of the adapter at the upper flange 40 of the base 37 is preferably about 2 mm; the height H2 at the lower flange 42 of the base 37 is preferably about 3 mm; and the height H3 of the arms 44, as they extend from the base is preferably about 3 mm, so that the total height of the adapter (H1+H2+H3), is about 8 mm. The parts of the dart, including the dart barrel, adapter, and dart shaft, are preferably made of brass or stainless steel, but they may be fabricated with any other material from which dart parts are commonly made.

Figure 2A:
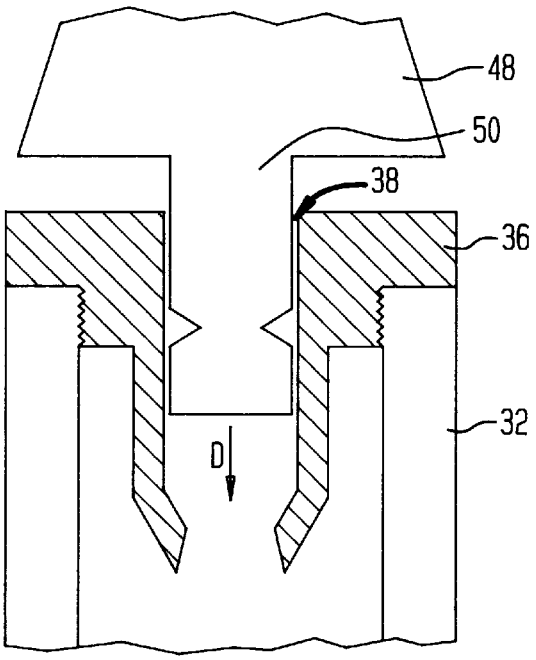
Figure 2B:
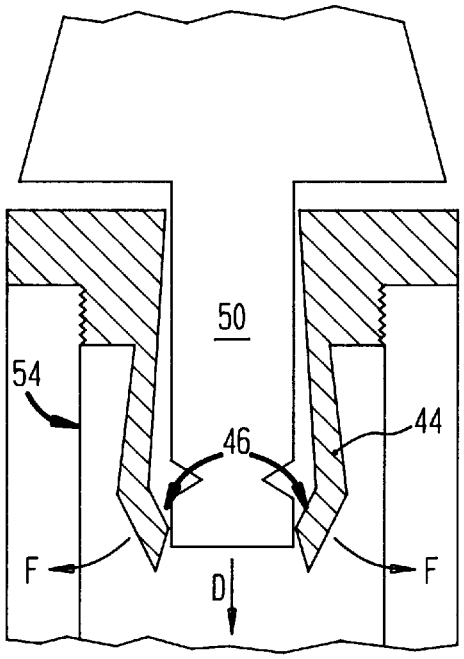
Figure 2C:
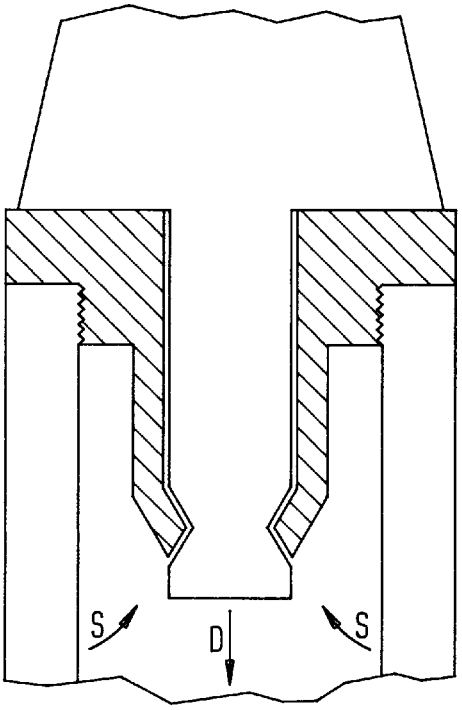
Figure 2D:
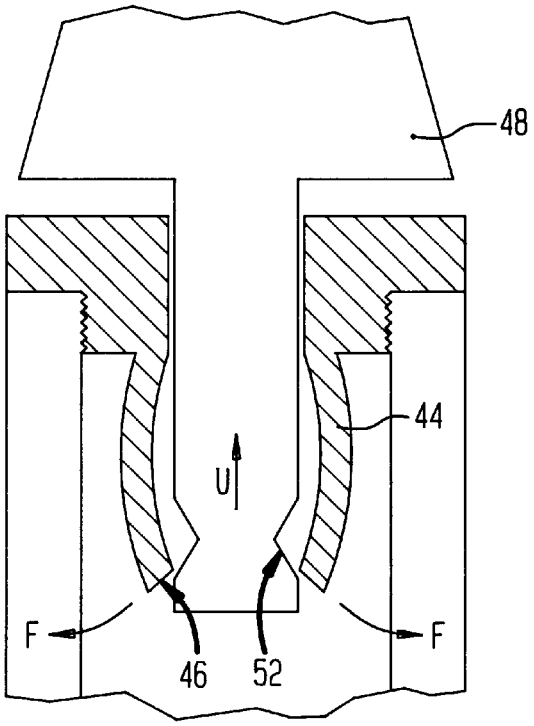
Figure 2E:
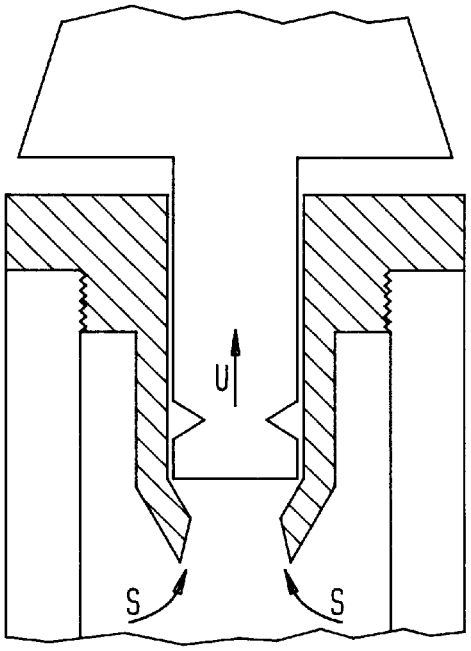

FIGS. 2A through 2E show the present invention dart in operation, wherein FIGS. 2A through 2C show the dart shaft 48 being inserted into the dart barrel 32, and FIGS. 2D and 2E show the dart shaft 48 being removed from the dart barrel 32.

Looking first at FIG. 2A, the adapter 36 is first secured onto the dart barrel 32. The projection 50 of the dart shaft is then inserted into the bore 38 of the adapter and pushed downward in the direction of arrow D. Looking at FIG. 2B, as the projection hits the detents 46 on the arms 44, the projection pushes and flexes the arms in the direction of arrows F, toward the inner surface of the walls 54 of the dart barrel 32. Looking now at FIG. 2C, as the projection is continued to be pushed in the direction of arrow D, the detents on the arms eventually align with the indentations on the projection, such that the arms 44 snap in the direction of arrows S, and then rest on the projection.

Conversely, FIGS. 2D and 2E show the operation of the dart wherein the dart shaft is being removed from the dart barrel. In particular, looking at FIG. 2D, as the dart shaft 48 is pulled upwardly in the direction of arrow U, the surface of the flange 52 on the projection pushes against the detents 46 and force the arms 44 to flex in the direction of arrows F. Looking at FIG. 2E, as the projection is continued to be pulled in the direction of arrow U, eventually the projection is disposed entirely within the space between the arms 44, such that the arms snap inwardly in the direction of arrow S into their resting position.

Figure 3A:
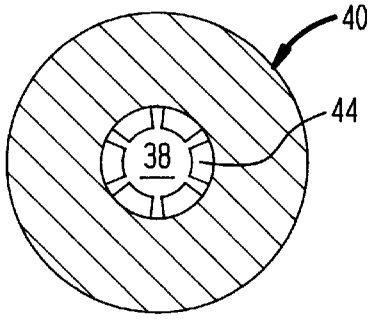

The adapter 36 need not be a separate component, but can be integrally molded into the dart barrel. However, it is preferable for the adapter to be separately constructed, as then the traditional threaded dart barrel can be converted into the snap-fit type. Looking at FIGS. 3A through 3F, there is shown the adapter in more detail (not to scale). FIG. 3A shows a top view of the adapter when the adapter is constructed in a ring-shape. The inner bore 38 and the upper peripheral flange 40 are viewable, as well as the plurality of arms 44 at the lower end of the bore. As noted above, the upper portion of the adapter can have a geometric shape, such as a hexagon, so that the user can more easily grip the outer peripheral flange 40 of the adapter and screw it into the dart barrel 32.

Figure 3B:
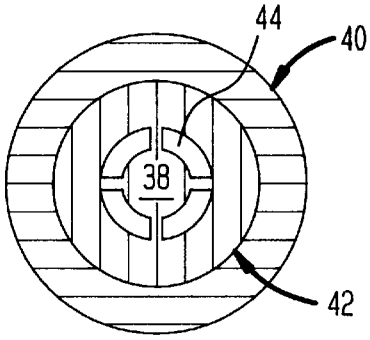
Figure 3C:
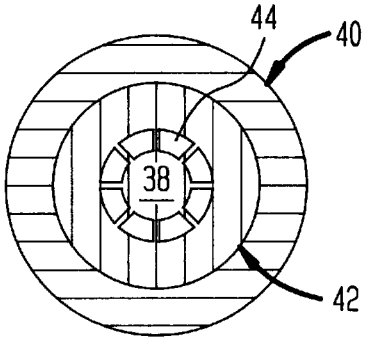
Figure 3D:
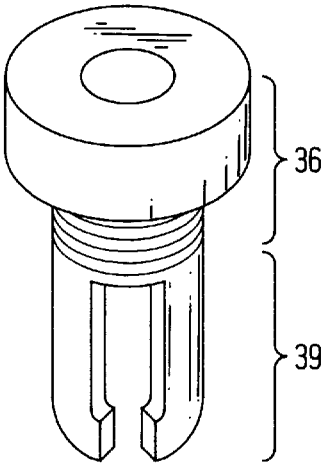
Figure 3E:
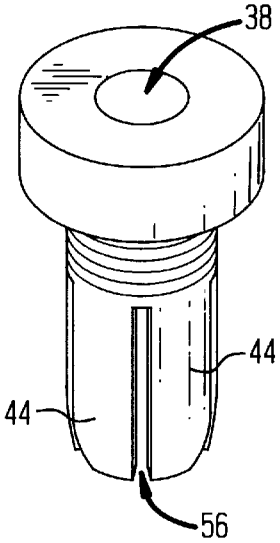
Figure 3F:
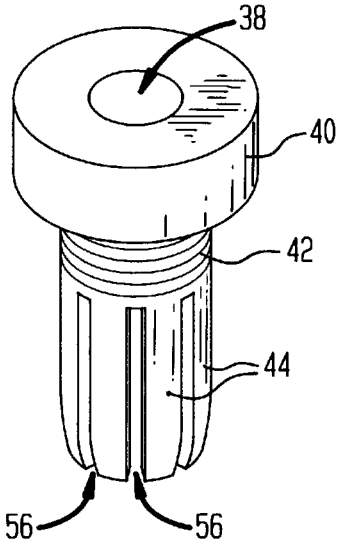

Looking at FIGS. 3B and 3C, there is shown bottom views of two alternative embodiments, wherein the first embodiment (FIG. 3B), contains four arms 44, and the second embodiment (FIG. 3C), contains eight arms 44. Similarly, FIGS. 3D through 3F show three alternative side views, wherein FIG. 3D has two arms 44; FIG. 3E has four arms (two are viewable); and FIG. 3F has eight arms (four are viewable). In FIGS. 3B, 3C, 3E and 3F, the plurality of arms 44 or clasping portion 39 of the adapter are formed essentially as a hollow cylinder extending downward from the base 36, wherein the cylinder has a plurality of slits 56 in its outer surface. Preferably, the adapter is constructed in this fashion with four to eight slits 56.

It will be further understood that the embodiments described herein are merely exemplary and that a person skilled in the art may make variations and modifications without departing from the spirit and scope of the invention. All such variations and modifications are intended to be included within the scope of the invention as herein described.

We claim:

1. In a dart with a dart barrel having a first end and a second end with a recess, a pin member secured to the first end of the dart barrel, and a dart shaft having a first end adapted for holding a flight and a second end with an elongated projection for inserting into the second end of the dart barrel, wherein the improvement comprises:

a connector member in the recess of the second end of the dart barrel having at least one detent; and a peripheral indentation on said elongated projection of the dart shaft for coactive engagement with the detent, whereby when the elongated projection is inserted into the connector member, the peripheral indentation selectively coacts with the detent thereby forming a snap-fit means for removably attaching the dart shaft to the dart barrel.

2. The apparatus of claim 1 wherein the connector member has a plurality of flexible arms having an outer surface and an inner surface relative to the recess of the dart barrel, and at least one detent located on the inner surface extending inwardly relative to the recess of the dart barrel.

3. The apparatus of claim 2 wherein the flexible arms flex outwardly within the recess of the dart barrel when the elongated projection is inserted.

4. The apparatus of claim 1 wherein the elongated projection has a peripheral detent and the connector member has a plurality of flexible arms with corresponding indents for coactively engaging with the peripheral detent when the elongated projection is inserted.

5. The apparatus of claim 4 wherein the flexible arms flex outwardly within the recess of the dart barrel when the elongated projection is inserted.

6. The apparatus of claim 1 wherein the first end of the dart barrel includes recess and a connector member in the recess with at least one detent, and the pin member has an elongated projection having a peripheral indentation for coactive engagement with the connector member thereby forming a snap-fit means for removably attaching the pin member to the dart barrel.

7. In a dart with a dart barrel having a first end and a second end with a recess, a pin member secured to the first end of the dart barrel, and a dart shaft having a first end adapted for holding a flight and a second end with an elongated projection for inserting into the second end of the dart barrel, wherein the improvement comprises:

a connector member in the recess of the second end of the dart barrel having a plurality of flexible extending arms and at least one detent; and a peripheral indentation on the elongated projection of the dart shaft for coactive engagement with the connector member, whereby when the elongated projection of the dart shaft is inserted into the connector member, said arms flex within the recess of the dart barrel to coactively engage with the peripheral indentation thereby forming a snap-fit means for removably attaching the dart shaft to the dart barrel.

8. The apparatus of claim 7 wherein there are four flexible arms.

9. The apparatus of claim 7 wherein there are eight flexible arms.

10. In a dart with a dart barrel having a first end and a second end with a threaded recess, a pin member secured to the first end of the dart barrel, and a dart shaft having a first end adapted for holding a flight and a second end having a projection for inserting into the second end of the dart barrel, wherein the improvement comprises:

an adapter having a base portion with an inner bore and a lower clasping portion for use in a threaded recess of a conventional dart for creating a snap-fit means for removably attaching the dart shaft to the dart barrel.

11. The apparatus of claim 10 wherein the base portion has an upper peripheral flange of a given diameter and a lower peripheral flange having a smaller diameter than the upper peripheral flange.

12. The apparatus of claim 11 wherein the lower peripheral flange is threaded for screwing the adapter into the barrel of a conventional threaded dart.

13. The apparatus of claim 12 wherein the lower clasping portion comprises a plurality of flexible extending arms with at least one detent.

14. The apparatus of claim 13, wherein the flexible arms have an outer surface and an inner surface relative to the recess of the dart barrel, and detents on the inner surface extending inwardly relative to the recess of the dart barrel.

15. The apparatus of claim 14 wherein the flexible extending arms flex outwardly within the second recess of the dart barrel when the projection is inserted.

16. The appparatus of claim 15 wherein the projection of the second end of the dart shaft has indentations corresponding to the detents on the flexible arms for inserting into the adapter.

17. An adapter kit for removably attaching a dart shaft adapted for holding a flight to a dart barrel having a threaded recess at one end of a dart barrel and a pin member secured to other end of the dart barrel, comprising:

a threaded connector member for threading into the recess of the dart barrel, the connector member having an inner bore and a lower clasping portion; and a peripheral indentation on an elongated projection of a dart shaft for coactive engagement with said lower clasping portion, whereby when said elongated projection is inserted into said inner bore, the peripheral indentation selectively coacts with said lower clasping portion thereby forming a snap-fit means for removably attaching said dart shaft to the dart barrel.

18. The adapter kit of claim 17, wherein said lower clasping portion comprises a plurality of flexible extending arms with at least one detent.

19. The adapter kit of claim 18, wherein said threaded connector has an upper peripheral flange of a given diameter and a lower peripheral flange having a smaller diameter than the upper peripheral flange.

20. The adapter kit of claim 19, wherein there are four flexible arms.

* * * * *